US006547636B1

(12) United States Patent
Cato

(10) Patent No.: US 6,547,636 B1
(45) Date of Patent: Apr. 15, 2003

(54) CONVERTIBLE BRASSIERE

(76) Inventor: Elaine A. Cato, 411 Pebble Creek Cir., Antioch, TN (US) 37013

( * ) Notice: Subject to any disclaimer, the term of this patent is extended or adjusted under 35 U.S.C. 154(b) by 0 days.

(21) Appl. No.: 09/686,459

(22) Filed: Oct. 11, 2000

(51) Int. Cl.[7] ..... A41C 3/00
(52) U.S. Cl. ..... 450/88; 450/86; 450/89
(58) Field of Search ..... 450/86, 88, 1, 450/36, 38, 41, 45, 46, 47, 48, 49, 50, 51, 52, 53, 54, 89

(56) References Cited

U.S. PATENT DOCUMENTS

| | | | | | |
|---|---|---|---|---|---|
| D35,666 | S | | 2/1902 | Wade | |
| 2,378,907 | A | * | 6/1945 | Blum | 450/88 |
| 2,440,426 | A | | 4/1948 | Barlow et al. | |
| 2,440,922 | A | | 5/1948 | Algon | |
| 2,679,048 | A | * | 5/1954 | Alberts | 450/36 |
| 2,869,553 | A | | 1/1959 | D'Or | |
| 3,109,431 | A | | 11/1963 | Jefferson | |
| 3,191,602 | A | | 6/1965 | Sturges | |
| 3,216,425 | A | | 11/1965 | De Keersmaecker | |
| 3,306,299 | A | * | 2/1967 | Paramore | 450/88 |
| 3,311,112 | A | * | 3/1967 | Murray | 450/88 |
| 3,411,508 | A | * | 11/1968 | Sayers | 450/88 |
| 3,465,754 | A | * | 9/1969 | Lockwood et al. | 450/88 |
| 3,595,243 | A | | 7/1971 | Mount | |
| 3,701,168 | A | | 10/1972 | Balow | |
| 3,982,547 | A | | 9/1976 | Walker | |
| 3,998,231 | A | | 12/1976 | Delet | |
| 4,091,819 | A | | 5/1978 | Huber et al. | |
| 4,217,905 | A | | 8/1980 | Atwater et al. | |
| 4,335,728 | A | * | 6/1982 | Fildan | 450/36 |
| 4,418,696 | A | | 12/1983 | Delet | |
| 4,992,074 | A | | 2/1991 | Diaz | |
| 5,149,336 | A | | 9/1992 | Clarke et al. | |
| D351,711 | S | | 10/1994 | Mattson | |
| 5,395,280 | A | | 3/1995 | Greenberg | |
| D358,247 | S | | 5/1995 | Nishiba | |
| 5,855,124 | A | | 1/1999 | Donaghy et al. | |
| 6,086,451 | A | * | 7/2000 | Fernandes | 450/86 |
| 6,155,906 | A | * | 12/2000 | May | 450/88 |
| 6,186,861 | B1 | * | 2/2001 | Flanerty | 450/1 |

* cited by examiner

*Primary Examiner*—Gloria M. Hale

(57) ABSTRACT

A convertible brassiere that converts from the general brassiere configuration to a backless configuration that is not visible when wearing backless apparel. Interchangeability of the present invention relates to certain features of construction to provide an end product of a backless brassiere. In a preferred embodiment, the backless configuration is achieved by manipulating and positioning the shoulder straps and the horizontal back strap of the brassiere. The shoulder straps are detached from the horizontal back strap and attached to the base extremities of the brassiere cups to convert to the backless configuration. Further, there are open vertical slits, within the brassiere cups, into which the extended ends of the unattached horizontal back strap is inserted when converting the brassiere to the backless configuration.

3 Claims, 4 Drawing Sheets

CONVERTIBLE BRASSIERE

BACKGROUND OF THE INVENTION

The present invention relates generally to brassieres, and more particularly to an improved convertible configuration of the brassiere that converts from the general brassiere to a backless brassiere to provide increased versatility, convenient use and comfortable support to the breast when wearing apparel designed to reveal the back of the human body as bare.

Women are constantly seeking comfortable brassieres that are appropriate for different styles of apparel, especially backless apparel. Women with larger breasts are faced with certain fashion limitations and often will not purchase backless apparel for public wear due to lack of support to the breasts and/or the exposed look of the breasts from the external appearance of the garment. When wearing brassieres in the prior art that expose the back of the human body in some manner, the wearer is subject to cumbersome lower visible horizontal straps or uncomfortable midsection control to the lower torso of the body.

In accordance with the present invention, there has been provided an improved construction of the brassiere that successfully accommodates the diverse wardrobe of the wearer because it can be worn in two fashions, as a general brassiere and in the backless configuration. The wearer saves money because only one brassiere is purchased instead of two for various fashions. Women will feel more confident in backless apparel knowing that their breasts are well supported.

SUMMARY OF THE INVENTION

The present invention deals with a brassiere of the general type and deals more specifically with the positioning of the shoulder straps and horizontal back strap that are manipulated in order to create a backless configuration for women who desire a feeling of freedom and security in knowing that their breasts are well supported when wearing backless apparel.

A first embodiment of a brassiere demonstrating the features of the present invention includes repositioning the shoulder straps, allowing the improved interchangeable configuration. This modification is accomplished when the shoulder straps are detached from the horizontal back strap of the brassiere to be repositioned to the base extremity of the brassiere cups. The shoulder straps are adjustable and flexible for comfort.

A second embodiment of a brassiere demonstrating features of the present invention includes concealing the unattached horizontal back strap by placing the extending ends within the open vertical slits inside the brassiere cups. By concealing the horizontal strap of the brassiere, the wearer's back is open and excludes any straps or other support structures so as to permit the wearing of backless apparel.

When the present invention is worn, the breasts of the wearer rest within the brassiere cups with the under-wire positioned beneath the breast for support and comfort. The free ends of the shoulder straps are draped over the shoulders of the wearer, encircling the armpits and are attached to the base extremity of the brassiere cups. The flexible shoulder straps are adjusted to secure a firm positioning against the shoulders of the wearer to assist with holding the brassiere in place.

An object of the present invention is to provide a modification to the general brassiere that will be most advantageous for a diverse wardrobe and cost effective for the wearer.

Another object is to provide a brassiere that is simple to manufacture.

Another object is to provide a brassiere convenient for everyday use and easily converted for backless fashions.

Another object is to provide a brassiere that is not visible when worn with backless apparel.

Another object is to provide a brassiere that provides support and comfort to the breasts.

BRIEF DESCRIPTION OF THE DRAWINGS

In order that the constructional form, features, and certain embodiments of the invention may be properly understood, detailed description is illustrated in reference to the accompanying drawings, wherein.

DESCRIPTION OF THE PREFERRED EMBODIMENTS

Figure 1:
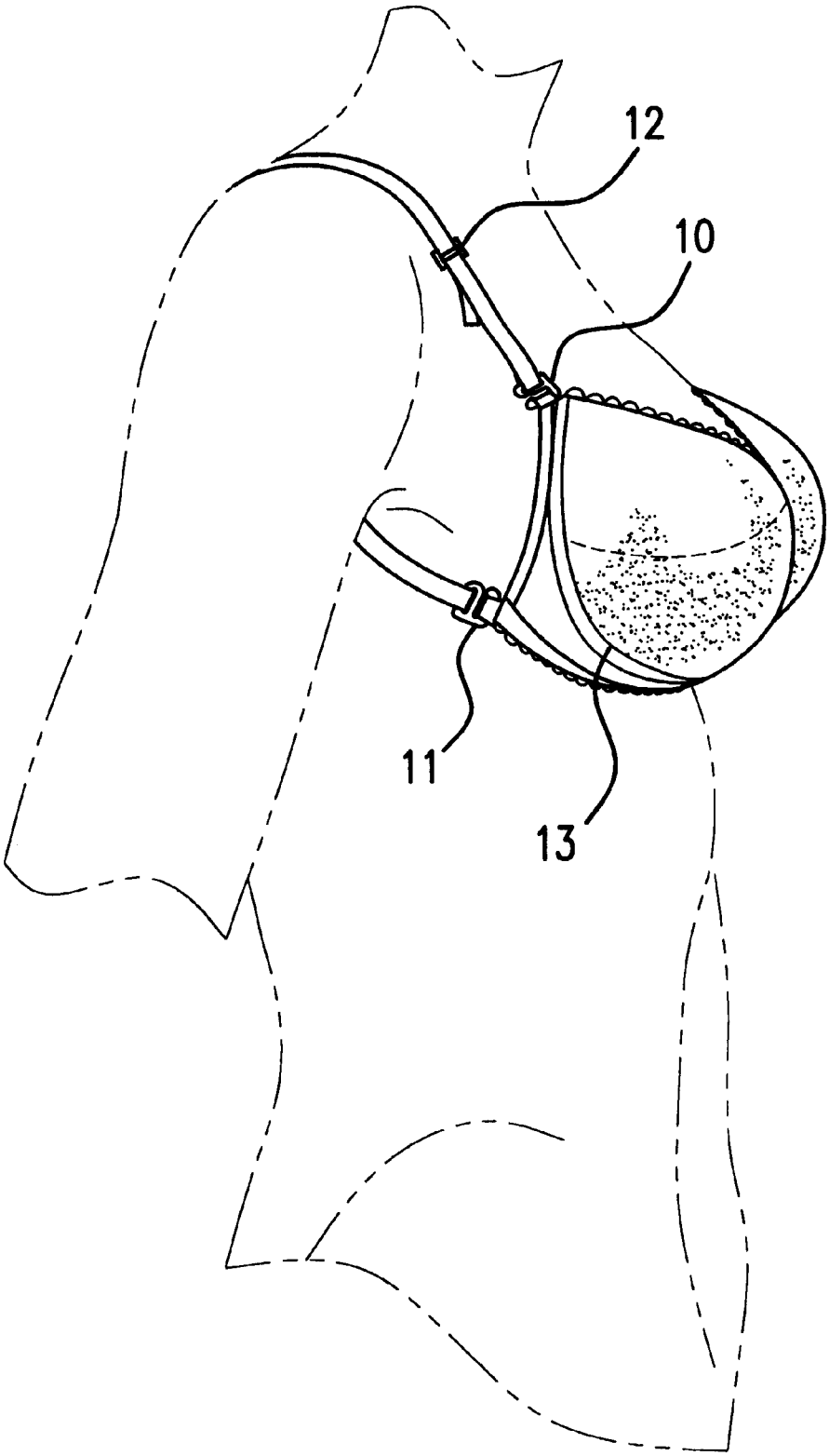
FIG. 1 is an inside view of the brassiere of the present invention before conversion to the backless configuration.

Referring now to the drawings, in FIG. 1, the brassiere of the present invention is shown and generally designated by the numeral 10. This is an inside view of the present invention 10, before conversion to the backless configuration, that exemplifies shoulder straps 16 and 18 still attached to the horizontal back strap 20. The shoulder straps, 16 and 18, are constructed with flexible elastic material and are also adjustable at 40 to assist with securing and holding the brassiere in place. The shoulder straps 16 and 18 are permanently attached at 22 and 24 to the brassiere cups 12 and 14. The inside construction of the brassiere cups 12 and 14 are formed of two superposed layers of soft flexible material suitable for brassieres. The inner layer of material within the brassiere cups has open vertical slits 30 and 32 for inserting and concealing the extending ends of the unattached horizontal brassiere strap 20. The brassiere cups 12 and 14 have an under-wire 38 sewn within the lower portion thereof for additional support and comfort to the breasts. The base extremities 26 and 28 of the brassiere cups 12 and 14 are the points of attachment for the free ends 34 and 36 of the shoulder straps 16 and 18 after being detached from the horizontal strap 20 when converting the brassiere.

Figure 2:
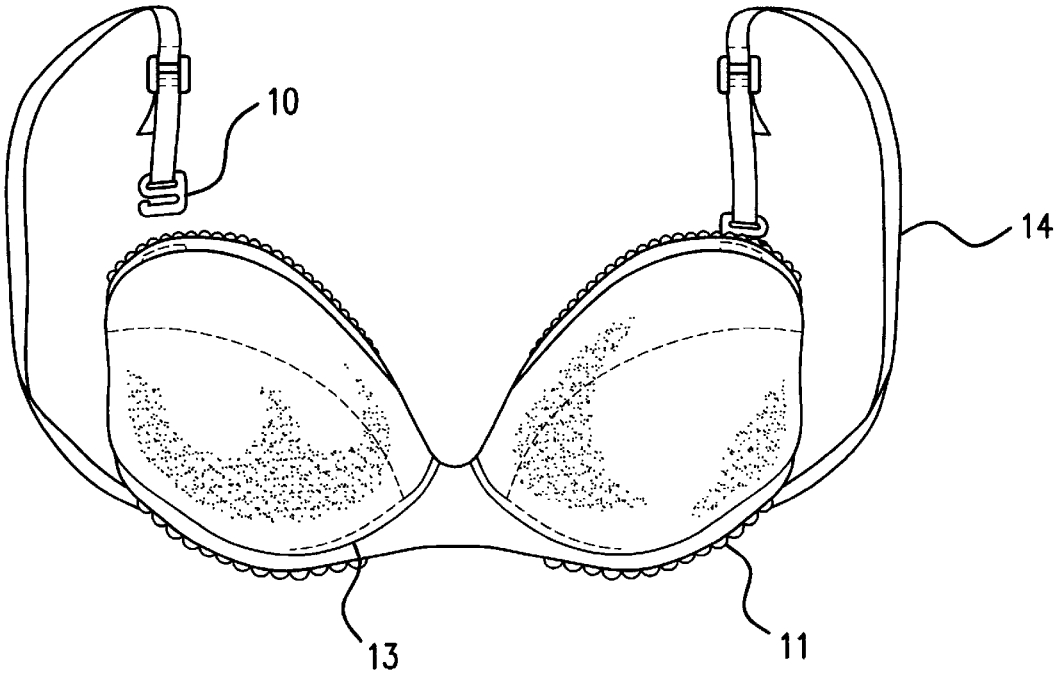
FIG. 2 is an inside view of the brassiere of the present invention after conversion to the backless configuration

In FIG. 2 of the drawings, the brassiere of the present invention 10 exemplifies the construction of the inventive concept. In this inside view of the present invention in the converted backless configuration, the shoulder straps 16 and 18 are permanently affixed at 22 and 24 to the brassiere cups 12 and 14. The free ends 34 and 36 of the shoulder straps 16 and 18 are repositioned for attachment to the base extremities 26 and 28 of the brassiere cups 12 and 14. The extended ends of the unattached horizontal brassiere strap 20 are inserted within the open vertical slits 30 and 32 inside brassiere cups 12 and 14.

Figure 3:
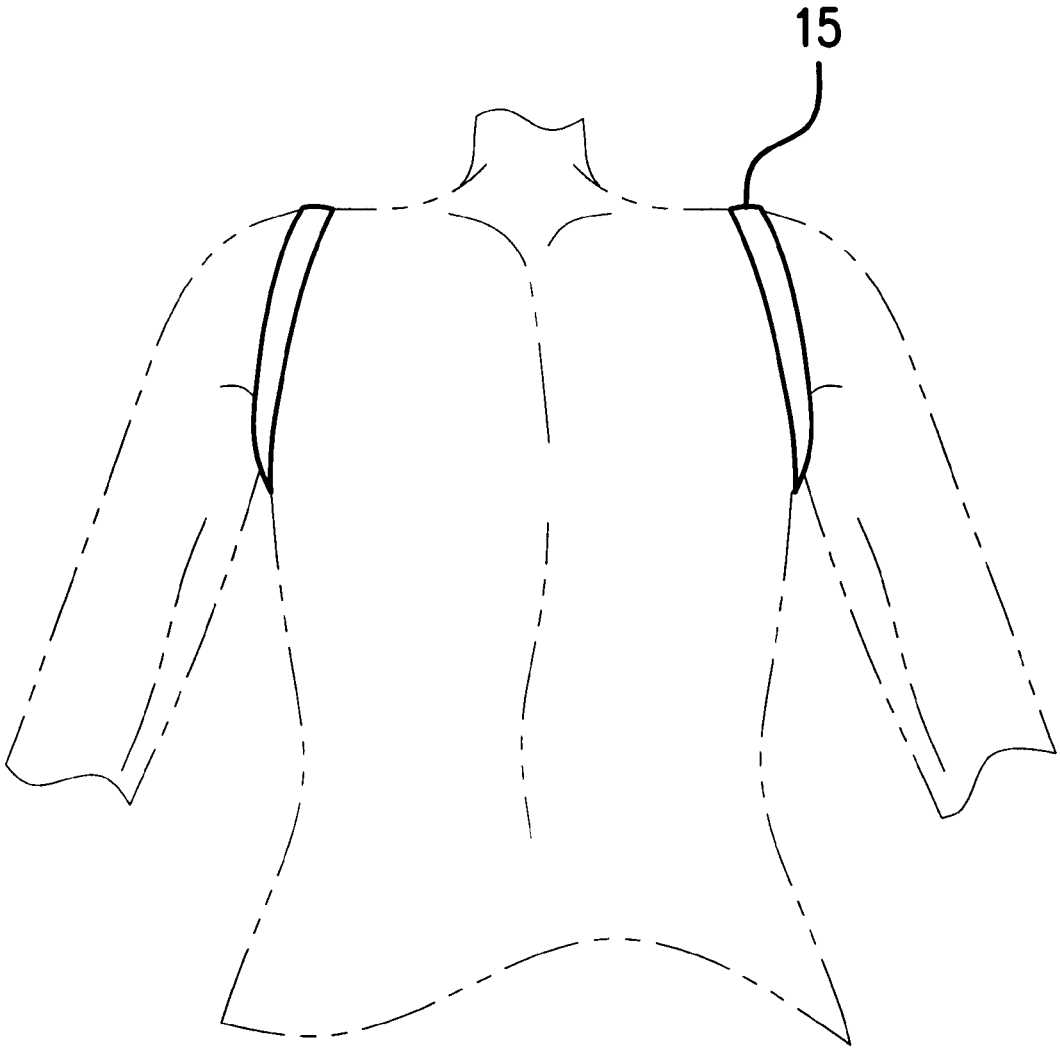
FIG. 3 is a side view of the brassiere of the present invention being worn in the backless configuration.

FIG. 3 shows a side view of the brassiere of the present invention 10 being worn in the converted backless configuration. The brassiere of the present invention 10 exemplifies how the shoulder strap 16, which is permanently affixed at 24 to the top extremity of brassiere cup 12, drapes firmly over the shoulder of the wearer, encircling the armpit where the detachable free end 36 of the shoulder strap is attached to the base extremity 28 of the brassiere cup 12. The under-wire 38 sewn within the brassiere cups is a main support means to the breasts. The shoulder strap 16 is elastic and adjustable 40 for comfort. The broken lines in FIG. 3 on the brassiere cup 12 indicate the positioning of the unattached vertical back strap 20 concealed within the open slit 30 while worn in the backless configuration.

Figure 4:
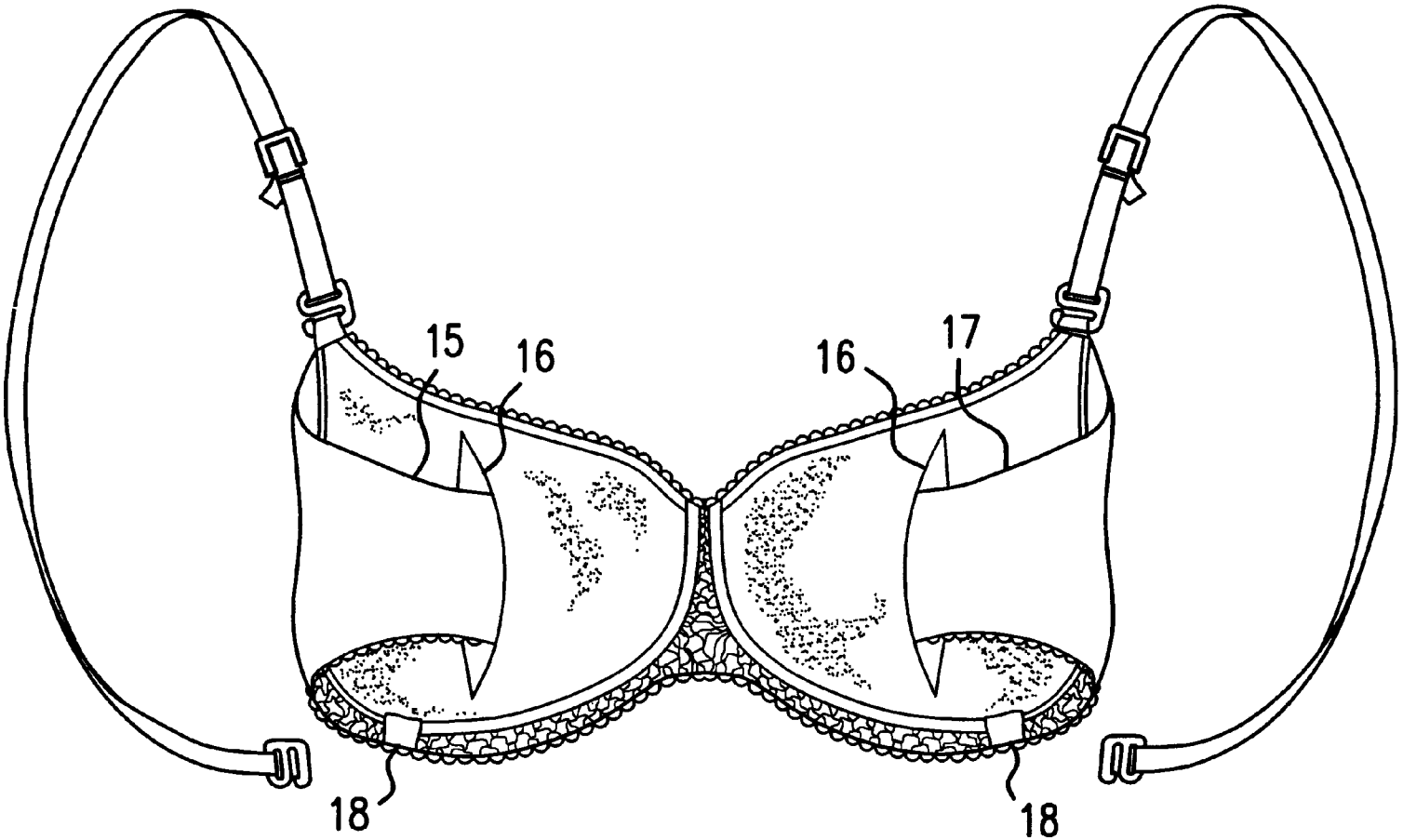
FIG. 4 is a rear view of a person wearing the brassiere of the present invention in the backless configuration.

FIG. 4 shows a back view of the present invention 10 being worn in its backless configuration. The adjustable shoulder straps 16 and 18 encircle and hug the wearer's shoulder and armpit, providing support to the breasts. There is no need for any support straps across the wearers back because the brassiere is held in place on the wearer by the positioning of the shoulder straps 16 and 18, which prevents the brassiere from falling forward. Due to the exclusion of a horizontal back strap, the back of the wearer is left open and bare.

It is contemplated that the construction of the brassiere of the present invention 10 may use any combination of nylon, cotton, spandex or any other suitable material and have any manner of lace, color or aesthetic design in its manufacturing. The shoulder straps 16 and 18 extending from brassiere cups 12 and 14 are attached to the horizontal back strap or the base extremities 26 and 28 of brassiere cups in any suitable manner, including means of small metal or plastic hooks, fabric loops or snaps in its manufacturing. Thus, although there has been described particular embodiments of the present invention of a new and useful convertible brassiere, it is not intended that such references be construed as limitations upon the scope of this invention except as set forth in the following claims.

What is claimed is:

1. A convertible brassiere which is convertible from a first conventional brassiere configuration to a second backless configuration comprising:

a pair of brassiere cups:

each of said brassiere cups constructed of two layers of fabric including an inner layer for placement adjacent to the body of the wearer and an outer layer thereby forming a pouch between said inner and outer layers;

each of said brassiere cup inner layers including a vertical slit therein which provides access to said pouch;

each of said brassiere cups including breast supporting means therein in the form of sewn-in underwire;

two horizontal back strap portions each having a first end attached to a side edge of each brassiere cup and a second end;

each horizontal back strap second end including a complementary fastener component on the other horizonal back strap portion when the brassiere is worn in the first conventional configuration to thereby secure the brassiere onto the wearer;

a pair of flexible and adjustable shoulder straps:

each shoulder strap having a first and second end; each first and second shoulder strap end having fastener components thereon; said shoulder strap first end is removably attached to a first upper edge of each brassiere cup and each shoulder strap second end is attached to an upper edge of each horizontal back strap;

each brassiere cup includes a base extremity, each with a fastener component thereon to accommodate the second shoulder strap end fastener component when it is removed from the horizontal back strap fastener component and then fastened to the base extremity fastener component which then allows the backless second brassiere configuration conversion when each of said horizontal back straps are inserted into each of the brassiere cup vertical slits.

2. A convertible brassiere as claimed in claim 1 wherein said brassiere cup is constructed of a soft, flexible material united by seams along brassiere cup edges to form two superimposed layers.

3. A method of converting a convertible bra from a conventional brassiere first configuration to a second backless configuration including the steps of:

providing a brassiere as claimed in claim 1 and converting the brassiere by:

detaching the two shoulder straps from the horizontal back straps; folding each horizontal back strap end and inserting each strap end into each vertical brassiere cup slit and into the pouch formed between the inner and outer brassiere cup layers; placing the breasts of the wearer into the brassiere cups and securing the underwire beneath the breasts for support and comfort; draping the two shoulder straps over the shoulders of the wearer, encircling the armpits of the wearer and attaching the detachable shoulder strap free ends to the base extremity fastener components under the brassiere cups and adjusting and positioning the shoulder straps, brassiere cups and underwire for a comfortable fit while providing an open back exposure without any straps to for use with backless apparel.

* * * * *